United States Patent [19]

Sturgeon

[11] 4,161,567

[45] Jul. 17, 1979

[54] PANELS FOR INDUSTRIAL DRYERS AND OTHER HEATED ENCLOSURES HAVING STAINLESS STEEL END STRUCTURAL SHEET ELEMENTS

[75] Inventor: Lloyd F. Sturgeon, Oreland, Pa.

[73] Assignee: Proctor & Schwartz, Inc., Philadelphia, Pa.

[21] Appl. No.: 832,423

[22] Filed: Sep. 12, 1977

[51] Int. Cl.[2] ..... B32B 15/18; E04C 2/08

[52] U.S. Cl. ..... 428/594; 52/404; 52/785; 52/802; 52/809; 52/821; 428/68; 428/920

[58] Field of Search ..... 428/608, 594, 920, 68–70, 428/71–74, 75, 76; 52/404, 615, 619, 620, 785, 802, 821–830; 220/90; 176/87

[56] References Cited

U.S. PATENT DOCUMENTS

| | | | |
|---|---|---|---|
| 2,739,677 | 3/1956 | Greulich | 52/615 X |
| 2,742,115 | 4/1956 | Strong | 52/615 X |
| 2,757,116 | 7/1956 | Clements | 52/615 X |
| 2,912,725 | 11/1959 | Ries | 52/404 X |
| 3,070,196 | 12/1962 | Switzergable | 52/615 X |
| 3,086,284 | 4/1963 | Schetky | 428/608 |
| 3,156,975 | 11/1964 | Shaw | 52/615 X |
| 3,190,412 | 1/1965 | Rutter et al. | 52/615 X |
| 3,212,864 | 10/1965 | Rhudy | 52/615 X |
| 3,488,255 | 1/1970 | Hayden et al. | 52/615 |
| 3,828,502 | 8/1974 | Carlsson | 52/620 X |
| 3,848,314 | 11/1974 | Stohr | 428/594 |
| 3,945,887 | 3/1976 | Lemercier | 176/87 |
| 3,991,242 | 11/1976 | Tuttle | 52/620 X |
| 3,998,024 | 12/1976 | Frandsen | 52/404 X |

*Primary Examiner*—Richard E. Schafer
*Attorney, Agent, or Firm*—Richard H. Thomas

[57] ABSTRACT

In a large high temperature industrial dryer or other such heated enclosure, a structural heat-insulation panel including opposed metallic sheets in generally parallel, spaced-apart planes, one of said sheets being exposed to a higher temperature than the other sheet, and insulation means between such sheets, wherein the improvement comprises panel ends formed of stainless steel of low heat conductivity. Particularly low heat transfer to the lower temperature sheet is obtained by employing embossed stainless steel pieces as said panel ends.

8 Claims, 7 Drawing Figures

PANELS FOR INDUSTRIAL DRYERS AND OTHER HEATED ENCLOSURES HAVING STAINLESS STEEL END STRUCTURAL SHEET ELEMENTS

The present invention relates to structural heat-insulation panels for large industrial dryers and other such heated enclosures.

BACKGROUND OF THE PRESENT INVENTION

Panels for large industrial dryers conventionally comprise two sheets of metal forming the inside high temperature surface and an outer surface exposed to ambient temperature and separated from the inside sheet by packed insulation such as glass or mineral fiber or foam, typically 1 to 10 inches in thickness. The panel ends or edges, which make up the remainder of the panel structure, and which serve to hold the inner and outer sheets together and retain the insulation in place, are often also of sheet metal and may include means for accommodating a sealing gasket, such as an asbestos or silicone rubber gasket, which bears against a structural frame member or element of the dryer. Such panels may be designed for clamping to upright frame elements, or may be hinged to act as access doors.

Heat transfer through the main body of a panel is effectively impeded by the insulation layer. However, the path through the sheet metal panel ends or edges offers a much lower thermal resistance than the insulation, resulting in heat leakage from the inside of the dryer enclosure to the lower temperature surface on the outside of the panel near the panel ends or edges. Often the heat leakage is significant enough to constitute a serious safety hazard.

A well-established technique for minimizing this problem is the use of non-metallic inserts, typically asbestos cement board in some configuration, in the structure of the panel ends or edges to act as barriers to conductive heat transfer through such ends or edges. Examples are shown in prior U.S. Pat. Nos. 2,912,725 and 3,991,242. These inserts are effective but significantly increase the cost of the panel and sometimes its durability due to special manufacturing techniques required for working with the insert material.

SUMMARY OF THE INVENTION

The above disadvantages are overcome, for a structural heat-insulation panel for dryers and other such heated enclosures, in accordance with the concepts of the present invention, by forming the panel ends or edges of stainless steel of low heat conductivity. Particularly low heat transfer to the lower temperature panel sheet is obtained by employing embossed stainless steel pieces as the panel ends.

Preferred stainless steels are of the 300-series, such stainless steels having the lowest thermal conductivity, about one-third of that of plain steel. However, the 400-series stainless steels, having a thermal conductivity about half that of plain steel, may be employed.

An embodiment of the present invention resides in employing, on the exposed side of the lower temperature sheet, a dark coating having a high surface heat emissivity. Increasing the rate at which heat is radiated from the low temperature sheet further reduces the end or edge temperatures of the panels, correspondingly reducing the safety hazard problem.

By "embossed," it is meant sheet metal which has been passed through forming rolls to impart a textured or grained, such as pebble, finish. The degree of roughness of surface relief is not critical, nor is the pattern of the finish, other than that the pattern should be relatively continuous. Reduced heat transfer can be obtained with a roughness of as little as a few microns. In a particular example, a roughness of approximately 0.15 inches (maximum pattern depth) gave a dramatically reduced heat transfer. The roughness can, of course, be much greater, limited only by the practicality of use of the subject piece as a panel end or edge.

The use of embossed pieces as the panel ends or edges has the advantage that it reduces the contact area at joints, for instance between the high temperature sheet and the stainless steel panel end or edge. This in turn has the effect of reducing the heat transfer at the joint. The embossing of the sheets also permits the use of lighter gauge metal, reducing the cross-sectional area normal to the flow of heat further resulting in a corresponding reduction in conductive heat transfer through the panel end or edge. The reduction in gauge is possible because the embossing process increases the effective section and therefore the stiffness of the sheet metal.

Another embodiment of the invention resides in locally dimpling or otherwise distorting flat sheet metal at the edges, of either the high temperature sheet or the panel end, to minimize the area of contact of the joint reducing the transfer of heat at the joint.

The invention and advantages thereof will become more apparent upon consideration of the following drawings, in which.

Figure 2:
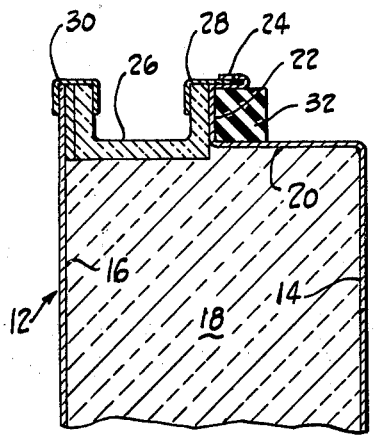
Fig. 2 PRIOR ART
FIG. 2 is a plan section view of one end of a heat-insulation panel constructed in accordance with the concepts of one embodiment of the prior art.

Turning to the drawings, one embodiment of the prior art is illustrated in FIG. 2. Referring to this figure, the numeral 12 indicates one end of a dryer or heated enclosure panel. It will be obvious to those skilled in the art that numerous such panels will be employed to make up a heated enclosure, such as the enclosure of a dryer. The panel is comprised of a first inner sheet 14 which is exposed to high temperatures within the dryer, and an outer sheet 16 exposed to ambient temperatures and conditions. Both the inner and outer sheets may be of corrosion resistant plain carbon sheet steel. The inner and outer sheets are in spaced-apart, parallel planes, and the space between the sheets is partially or completely filled with suitable insulation 18, such as glass or mineral fiber or foam, to hinder the flow of heat from the inner sheet 14 to the outer sheet 16. The insulation layer may be of any thickness desired, depending upon the type of dryer or heated enclosure and temperatures involved .

As indicated above, the problem with panels for heated enclosures has been the means employed to form the panel ends. To avoid thermally shorting the inner and outer sheets of the panel at the panel ends, the art has frequently gone to complex joints. In this particular case, the inner sheet 14 is provided with a flanged edge 20 which extends at a plane normal to the plane of sheet 14 in the direction of the outer panel 16. The flange edge 20 in turn is bent at its free end to provide a seat 22 or surface which extends in a plane parallel to the planes of sheets 14 and 16 terminating in an edge bent in the shape of a U to form a pocket 24 facing the outer panel 16. A U-shaped insert 26 is then positioned between the seat 22 and the outer sheet 16. This insert 26 is made of an asbestos cement board or similar heat-insulation material and is held in place by clips 28 and 30. The clip 28 engages pocket 24, whereas the clip 30 slides over and is held by oppositely facing surfaces of the outer sheet 16 and a flange of insert 26. The problem with this and similar designs is the durability of the construction and its cost.

In the embodiment of FIG. 2, the panel flange edge 20 is shaped to engage, between seat 22 and pocket 24, a sealing gasket 32 which is adapted to bear against a frame or similar structural element of the dryer. Means not shown are provided for clipping the panel to the structural element.

Figure 1:
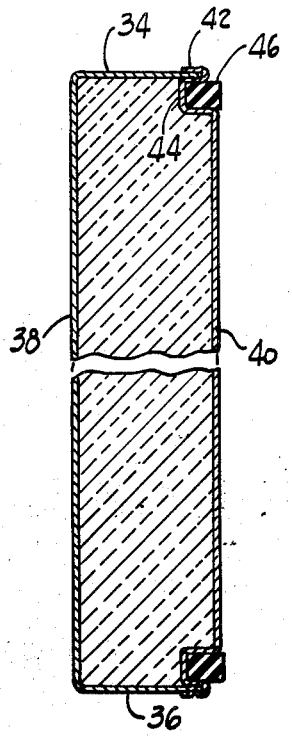
FIG. 1 is a plan section view of a heat-insulation panel for a dryer or other large heated enclosure incorporating the concepts of the present invention.
Figure 3:
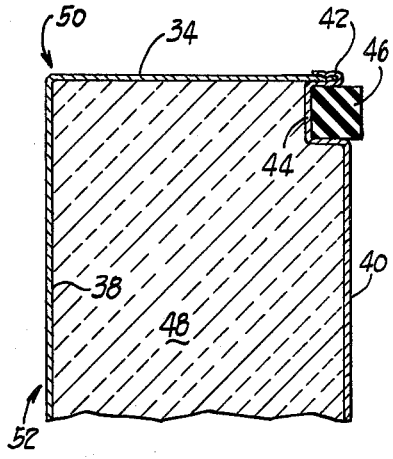
FIG. 3 is an enlarged, plan, section view of one end of the dryer panel of FIG. 1.

An embodiment incorporating the concepts of the present invention is illustrated in FIGS. 1 and 3. In this embodiment, the panel ends 34 and 36 are integral parts of the outer sheet 38 of the panel, the sheet which is exposed to ambient temperature. This sheet is simply curved at its edges into the shape of a U to form edge flanges which extend in planes normal to the plane of the outer sheet. The inner sheet 40 at its edges is bent to define pockets 42 which are crimped on the free edges of the ends 34 and 36 to form joints connecting the sheets 40 and 38 together. No insulation is necessary in the joints. The significant feature is that the outer sheet and the flange ends 34 and 36 are made of stainless steel, preferably 304 stainless steel. As with the embodiment of FIG. 2, the inner sheet 40 is cupped at 44 to retain a sealing member 46. Insulation 48 is provided between the sheets 38 and 40.

Figure 5:
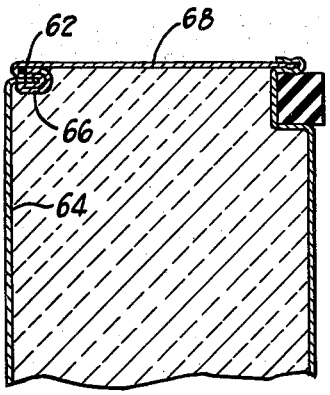
FIGS. 4, 5 and 6 are plan section views of portions of dryer panels illustrating embodiments of the present invention.
Figure 4:
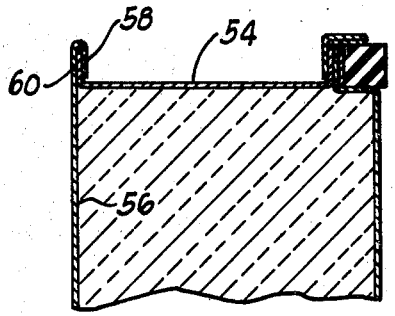
Figure 6:
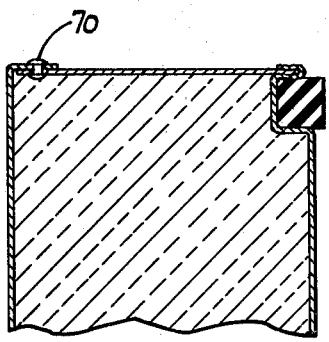
Figure 7:
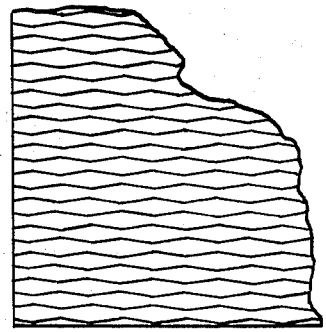
FIG. 7 is an elevation view of a portion of an embossed panel sheet in accordance with the concepts of the present invention.

FIGS. 4, 5 and 6 illustrate embodiments of the present invention. In the embodiment of FIG. 4, the panel edge 54 is not an integral part of the outer sheet 56. Rather, the outer sheet 56 is formed with an end pocket 58 into which a short flange 60 of edge 54 is seated. In the embodiment of FIG. 5, a flange 62 is provided on the edge of outer sheet 64, and this is embraced by slot 66 formed along the outer edge of the panel end piece 68. In FIG. 6, the joint 70 is made by riveting.

The data of the following example will illustrate the present invention and its advantages.

EXAMPLE 1

A series of tests were conducted on 2-inch thick panels built with different types of edge constructions and were compared with a control panel of conventional two-piece design. This control panel had a construction similar to that shown in FIGS. 1 and 3, except that the outer sheet 38 and ends 34 and 36 were of a conventional corrosion resistant, aluminized carbon steel, Armco Type 1, Armco Steel Corp. Two indices of performance were used: the average temperature of the outside edge (edge 50 in FIG. 3), and the average temperature over that portion of the surface far enough removed from such edge to show no significant gradient towards the edge (surface 52 in FIG. 3). The tests were conducted with an inside temperature of 400° F. and an outside (ambient) temperature of 80° F.

The panel constructions other than the control were as follows. The first panel was somewhat similar in design to the panel of FIG. 2 employing end inserts of "Glasweld," trademark U.S. Plywood Corporation, an asbestos cement board. This panel differed from that of FIG. 2, however, in that the end inserts were one-eighth inch thick, flat pieces, held in place with Sylastic Type 732, a room temperature vulcanizing silicone rubber adhesive. The flat inserts extended virtually the entire distance between the inner sheet and the outer sheet and were secured to short flanges at the edges of each sheet.

The second design was essentially that shown in FIG. 6, except that the inserts were of 304 stainless steel, 24 gauge (0.025 inch thickness). The stainless steel inserts were plain and not embossed. In this test, the 304 stainless steel pieces were secured to flange edges of the inner and outer sheets by riveting. Contact between the inner and outer panel sheets and the inserts was substantially continuous.

The third design was similar to the second, having riveted 304 stainless steel inserts as the panel ends, except that the outer surface of the outer sheet was painted with a heat emissive blue paint (Glidden 510AO2113, a fast drying blue enamel sold by the Glidden Coatings and Resins Division of SCM Corp.) having a high rate of radiation from the sheet to its surroundings. Two coats were applied. The following table gives the test results.

All designs utilized U.S. Gypsum insulation SF-234.

Table 1

| Test Run | Description | Surface Average (°F.) | Edge Average (°F.) |
|---|---|---|---|
| Control | Panel of Figs. 1 and 3 employing aluminized steel outer sheet and ends. | 135 | 176 |
| 1 | Asbestos Sheet Inserts for panel ends. | 125 | 139 |
| 2 | Stainless Steel Inserts for panel ends. | 128 | 143 |
| 3 | Same as Run 2; panel outer surface painted with heat emissive paint. | 115 | 130 |

The above data shows that all three experimental designs were clearly superior in performance to the control design. The second design with asbestos end inserts was the best, but very comparable results were obtained in the third design using 304 stainless steel. For instance, edge temperature was reduced to 143° versus 176° for the control. The fourth design employing a heat emissive surface on the outer sheet achieved results even better than that obtained with the asbestos inserts. By increasing the rate at which heat is radiated from the panel to the surroundings, not only was the surface average temperature reduced, but the edge average temperature was substantially reduced, from 176° to 130°.

A 4-inch thick panel with asbestos-channel side inserts having the exact construction shown in FIG. 2 yielded, under the same test conditions, a surface average temperature of 121° F. and an edge average temperature of 132° F., somewhat better than the plain 2-inch panel with stainless steel edges, but not as good as the same 2-inch panel with a heat emissive surface.

EXAMPLE 2

This example illustrates the advantages of the invention employing a joint which is thermally discontinuous, such as that obtainable using embossed stainless steel as an edge material. As mentioned above, the embossing process offers the additional advantage of stiffening and work hardening the material, permitting the use of a thinner gauge. By the reduction of heat transfer area, still less heat transfer is obtained through the panel ends.

In this example, the control was the same as in Example 1, except that the panel had a thickness of 4 inches. The first test panel was similar in design to that of FIGS. 1 and 3, except that the outer sheet and integral ends were of embossed 304 stainless steel. The inner sheet was of standard aluminized steel. The embossed stainless steel sheet was design No. 5WL, marketed by Rigidized Metals Corp., Buffalo, N.Y., and had an average thickness of 0.025 inches, a maximum thickness of 0.037 inches, and a maximum pattern depth of 0.015 inches.

The second test panel was of the same construction as the third test panel of Example 1, illustrated in FIG. 5 employing embossed stainless steel inserts and an outer sheet coated with heat emissive paint. The control was 4 inches in thickness with the same insulation employed in Example 1. Both the first and second test panels were also 4 inches in thickness.

In the control test, the inside temperature was 370° F. and ambient temperature was 79° F. In the two comparative tests using the first and second test panels, inside temperature was 365° F. and ambient temperature was 83° F. The following data was obtained.

Table 2

| Test Run | Description | Surface Average (°F.) | Edge Average (°F.) |
|---|---|---|---|
| Control | Panel of Figs. 1 and 3 employing aluminized steel outer sheet and ends. | 108 | 129 |
| 1 | Panel of Figs. 1 and 3 employing embossed stainless steel outer sheet and ends. | 103 | 109 |
| 2 | Panel of Fig. 5 with embossed stainless steel inserts. | 97 | 103 |

It is evident from the data of the above table that the embossed stainless steel provides dramatically superior results particularly with regard to average edge temperature. Slightly better performance was obtained using embossed stainless steel which was coated on the outside with a heat emissive paint, particularly with regard to average surface temperature. The cost of the designs utilizing embossed stainless steel is about one and one-half times that of the control, but it is substantially less than the cost, for labor and materials, of the design of FIG. 2. The control design, of course, presents a serious safety problem, particularly for higher dryer temperature, whereas this problem is alleviated with the use of stainless steel.

Although the 300 stainless steels are preferred because of thermal conductivity, being about one-third that of plain steel, the 400-series can also be employed, having a conductivity about one-half that of plain steel.

An advantage of the present invention is that it can be utilized with a wide range of dryer temperatures. For instance, good results have been obtained with operating temperatures of about 700° F. employing 8-inch thick panels. Even higher temperatures, as high as 800° F., may be employed.

What is claimed is:

1. A structural heat-insulation panel for high temperature industrial dryers and such other heated enclosures comprising inner and outer opposed metallic sheets in generally parallel, spaced-apart planes, one of said sheets being exposed to higher temperature than the other sheet, said sheets defining a space therebetween;

insulation means in said space;

end structural sheet elements connecting said inner and outer sheets together and enclosing said space;

said end sheet elements having sufficient strength to act as load bearing members between the inner and outer sheets;

said end sheet elements being of low heat conductivity stainless steel.

2. The panel of claim 1 wherein said end structural elements are of 300-series stainless steel.

3. A structural heat-insulation panel for high temperature industrial dryers and such other heated enclosures comprising inner and outer opposed metallic sheets in generally parallel, spaced-apart planes, one of said sheets being exposed to higher temperature than the other sheet, said sheets defining a space therebetween;

insulation means in said space;

end structural sheet elements connecting said inner and outer sheets together along lines of connection and enclosing said space;

said end sheet elements having sufficient strength to act as load bearing members between the inner and outer sheets and being of low heat conductivity stainless steel;

said end sheet elements or panels or both being embossed along said lines of connection to reduce the heat flow between the inner and outer panels.

4. The panel of claim 3 wherein said end structural elements are of 300-series stainless steel.

5. A structural heat-insulation panel for high temperature industrial dryers and such other heated enclosures comprising inner and outer opposed metallic sheets in generally parallel, spaced-apart planes, one of said sheets being exposed to higher temperature than the other sheet, said sheets defining a space therebetween;

insulation means in said space;

end structural sheet elements connecting said inner and outer sheets together along lines of connection and enclosing said space;

said end sheet elements having sufficient strength to act as load bearing members between the inner and outer sheets and being of low heat conductivity stainless steel;

said outer sheet being painted on its outer surface with a heat emissive paint.

6. The panel of claim 5 wherein said end structural elements are of 300-series stainless steel.

7. The panel of claim 6 wherein said lines of connection between the inner and outer sheets and end structural elements are noncontinuous to reduce thermal conductivity.

8. The panel of claim 7 wherein said end structural elements or inner and outer panels or both are embossed along said lines of connection to reduce the heat flow between the inner and outer panels.

* * * * *